United States Patent [19]

Polko

[11] 4,066,015

[45] Jan. 3, 1978

[54] STATIONERY PRINTING APPARATUS FOR CONTINUOUS BUSINESS FORMS STATIONERY ASSEMBLIES

[75] Inventor: Peter R. Polko, Barrington, Ill.

[73] Assignee: Uarco Incorporated, Barrington, Ill.

[21] Appl. No.: 595,074

[22] Filed: July 11, 1975

[51] Int. Cl.[2] ..... B41F 13/02

[52] U.S. Cl. ..... 101/228; 226/100; 101/219; 197/187; 33/184.5

[58] Field of Search ..... 226/32, 100; 101/228, 101/248, 212, 219, 181, 183, DIG. 12, 216; 197/187, 133 R, 133 T, 133 P, 133 F; 33/184.5, 1 B

[56] References Cited

U.S. PATENT DOCUMENTS

| | | | |
|---|---|---|---|
| 1,889,453 | 11/1932 | Richardson | 226/100 |
| 3,125,335 | 3/1964 | Becker | 226/91 |
| 3,152,542 | 10/1964 | Chambon | 101/181 |
| 3,198,114 | 8/1965 | Jones et al. | 101/228 |
| 3,229,631 | 1/1966 | Peterson | 101/228 |
| 3,292,763 | 12/1966 | Whitehead | 197/187 |
| 3,373,684 | 3/1968 | Fisher | 101/228 |
| 3,386,637 | 6/1968 | Green et al. | 226/100 |
| 3,658,163 | 4/1972 | Sniderman | 197/133 R |
| 3,808,971 | 5/1974 | Staamann | 101/228 |
| 3,915,090 | 10/1975 | Horst et al. | 101/248 |
| 3,973,664 | 8/1976 | Wanat | 197/133 R |

*Primary Examiner*—Edgar S. Burr
*Assistant Examiner*—William Pieprz
*Attorney, Agent, or Firm*—Wegner, Stellman, McCord, Wiles & Wood

[57] ABSTRACT

Stationery printing apparatus for printing indicia at a predetermined position on each form length of continuous business forms stationery assemblies. The apparatus embodies a unique arrangement of a printing device in connection with a form feeding device and lineup indicia so that positive, accurate registration between the printing device and the predetermined position on each form length for receipt of the printing is obtained before a printing is initiated, thereby eliminating any need for registration adjustment during a printing run.

9 Claims, 6 Drawing Figures

STATIONERY PRINTING APPARATUS FOR CONTINUOUS BUSINESS FORMS STATIONERY ASSEMBLIES

BACKGROUND OF THE INVENTION

This invention relates to printing apparatus and, more particularly, to printing apparatus for use in printing upon continuous business forms stationery assemblies and on each form length thereof.

The use of continuous business forms stationery assemblies has increased significantly in recent years, in part due to the development of increasingly sophisticated forms handling equipment. Consequently, many forms, heretofore employed in so-called "unit set" form are now employed in continuous form.

Various types of such forms frequently require printing on each form length at a predetermined position, such as the imprintation of a validating signature on checks, stock certificates, or the like. Various printing devices have been developed for providing such imprintation, normally, just prior to some operation such as a bursting operation.

In the case of checks or stock certificates, etc., there has been one continual difficulty with the printing devices heretofore known. Such prior art printing devices have failed to provide for accurate registration of the form with respect to the printing device prior to startup of the printing run. That is, on such forms where it is desired to print, for example, a validating signature, at a predetermined position, prior art print devices have not permitted accurate setup on a time after time basis of the form with respect to the printing device such that for the first form length, and every form length thereafter, printing will occur exactly where desired.

While, with many types of forms, a few form lengths with misregistered printing can be disposed of, this is extremely inconvenient in he case of checks or stock certificates or other documents which are sequentially numbered. In the case of such documents, where there is improper registration, and one or more form lengths must be discarded, it is necessary to make an entry in a record as, for example, voiding the particular check or stock certificate.

Thus, there is a real need for a printing apparatus for continuous business forms stationery assemblies which provides accurate registration prior to the beginning of the run thereby eliminating the possibility of ruined form lengths and the resultant need for bookkeeping entries.

SUMMARY OF THE INVENTION

It is the principal object of the invention to provide a new and improved printing apparatus for use in repetitive printing on each form length of continuous business forms stationery assemblies. More specifically, it is an object of the invention to provide such a printing apparatus wherein accurate registration of the stationery assembly with respect to a printing device is achieved prior to initiation of operation with a minimum of effort to preclude the possibility of one or more individual form lengths of the stationery assembly from being improperly printed upon.

An exemplary embodiment of the invention achieves the foregoing object in a printing device including a rotary printing roll having N equally circumferentially spaced printing surfaces. The printing surface or surfaces are spaced from the axis of the rotation of the roll radially a distance equal to $NL/2\pi$. L is taken as the distance between two adjacent transverse lines of weakening separating the continuous business forms stationery assembly into individual form lengths and N is an arbitrarily selected integer of 1 or more.

An impression device is associated with the roll to define a printing nip such that the forms passing through the nip will be imprinted upon by the printing surface at the nip. A conveyor is provided for driving continuous business forms stationery assemblies along a path of stationery travel extending through the nip and includes a drive mechanism forwardly of the nip for positively advancing the stationery along the path at a desired linear velocity. Means are provided for rotating the roll such that the printing surface is rotated at an angular velocity equal to the linear velocity of the form whenever the drive mechanism is operative.

At least one first lineup indicia is located along the path and forwardly of the nip, while a second lineup indicia is operatively associated with the roll so that the roll may be initially located at a predetermined angular position relative to its axis of rotation. The first indicia is spaced from the nip a distance $D_1$, while the second indicia is positioned such that when the roll is in the predetermined angular position, the printing surface will be angularly spaced from the nip by a distance $D_2$. $D_1$ is related to $D_2$ as follows:

$$D_1 = D_2 \pm nL - X,$$

where $n$ is 0 or an integer of 1 or greater, and $X$ is the longitudinal distance, if any, between the predetermined position on the form length whereat printing is to take place and an arbitrarily selected index point, if any, on the form length to be aligned with the first lineup indicia.

As a consequence, when the roll is located in its predetermined angular position using the second indicia, and a continuous business forms assembly having forms of individual length equal to L is initially positioned with the predetermined printing position for the arbitrarily selected index point, if any, of one of the form lengths adjacent the first indicia, upon operation of the conveying means, the form length will be imprinted upon at the predetermined printing positions thereon.

Other objects and advantages will be apparent from the following specification taken in connection with the accompanying drawings.

DESCRIPTION OF THE PREFERRED EMBODIMENTS

Figure 1:
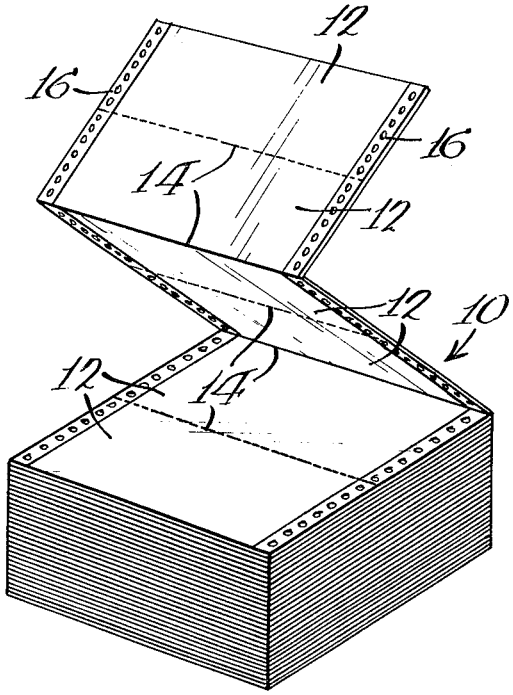
FIG. 1 is a perspective view of a continuous business forms stationery assembly of the type that may be employed with the printing apparatus of the present invention.

A typical continuous business forms stationery assembly is illustrated in FIG. 1 and is generally designated 10. The same is seen to be folded into a zig-zag stack. The assembly 10 is comprised of a plurality of individual form lengths, each designated 12, separated from each other by transverse lines of weakening 14.

Along one or both of the marginal edges of the assembly, there extend control punch margins 16, by which the assembly 10 may be positively fed through processing equipment.

Figure 2:
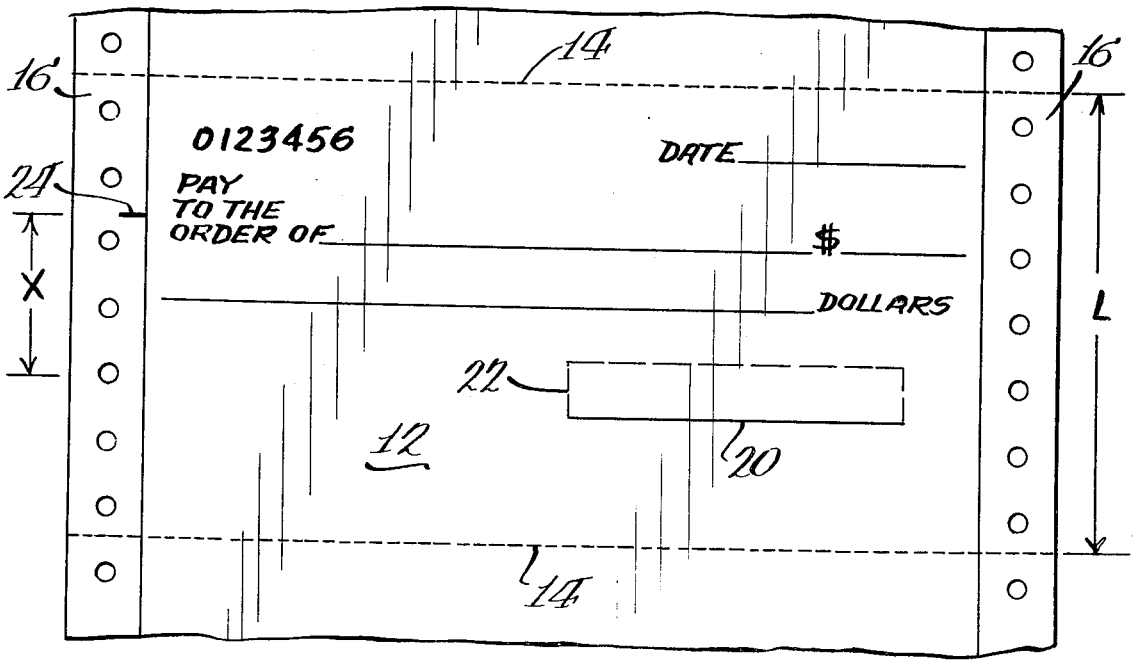
FIG. 2 is an enlarged, fragmentary view of a form length of the continuous business forms stationery assembly.

Referring now to FIG. 2, the same illustrates one form length 12 of the assembly 10. The face of the form length 12 bears a variety of indicia typically found on a check or the like and includes a signature line 20. The signature line 20 together with a dotted line 22, which would not actually appear on the face of the form length 12, define a predetermined printing position on the form length 12. That is, within the box formed by the lines 20 and 22, a validating signature must be impressed.

FIG. 2 also illustrates a dimension L, the significance of which will become apparent hereinafter. The dimension L is the distance between adjacent lines of weakening 14. That is, the dimension L is equal to the length of the form length 12 measured longitudinally along the assembly 10.

FIG. 2 also illustrates a dimension X, the signficance of which will also become apparent hereinafter. It is equal to the longitudinal distance between the center of the predetermined printing position defined by the lines 20 and 22 and an arbitrarily chosen index mark 24. Where the index mark 24 is located on the form length 12 above the predetermined print position, as illustrated in FIG. 2, that is, is located closer to the top of the form than the print position, X will have a positive value. If the index mark 24 is below the predetermined print position, X will have a negative value.

Figures 3, 4:
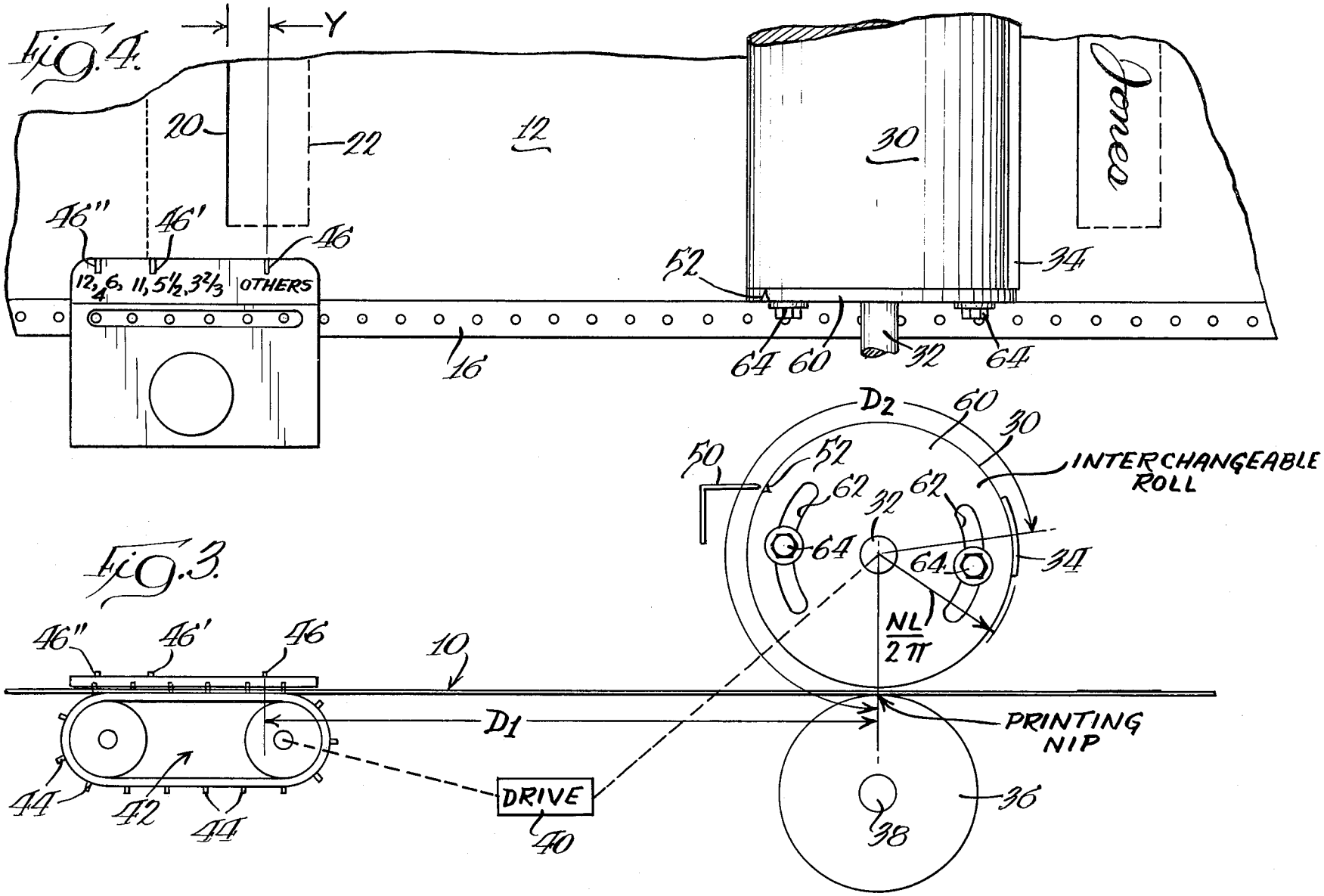
FIG. 3 is a somewhat schematic, side elevation of a printing apparatus made according to the invention.
FIG. 4 is a fragmentary, plan view of the apparatus of FIG. 3.

Turning now to FIGS. 3 and 4, an exemplary embodiment of a printing mechanism made according to the invention is illustrated in somewhat schematic form. For more specific details of a preferred construction, reference may be had to the copending, commonly assigned application of Davis, Ser. No. 506,190, filed Sept. 16, 1974, and entitled "Burster", the details of which are herein incorporated by reference.

The printing mechanism includes a print roll 30 mounted for rotation on a shaft 32. The print roll 30, at its cylindrical periphery, mounts a printing plate 34 defining a printing surface. Below the print roll 30, an impression cylinder 36 is mounted for rotation on a shaft 38. The rolls 30 and 36 define a printing nip at their point of adjacency.

The print roll 30 is adapted to be driven in a counterclockwise direction, as viewed in FIG. 3, by a drive mechanism designated 40. The drive mechanism 40 is also operative to drive a tractor device, generally designated 42, which may be of the type disclosed in the previously identified Davis application. The same includes a plurality of pins 44 which are driven in a predetermined path to enter the apertures in the control punch margin 16 of the assembly 10 to positively advance the assembly 10 along a path of stationery travel, which path passes between the rollers 30 and 36, that is, the path passes through the printing nip.

By suitably selecting drive ratios, the tractor assembly 42 is operative to drive the assembly 10 at a linear velocity through the printing nip which is equal to the angular velocity of the printing surface 34 about the axis of rotation of the roller 30, namely, the shaft 32.

A stationery lineup mark 36 is provided along the path of stationery travel ahead of the printing nip. As illustrated in FIG. 4, three such marks 46, 46′ and 46″ are employed. Such marks, individually and collectively, constitute first lineup indicia and are intended to be used for lineup purposes when the assembly 10 is placed on the tractor assembly 42. Specifically, the mark 46 is to be used as follows. The center of the predetermined print position or the arbitrary index point 24 for certain form lengths is to be aligned with the index point 46. Alternately, for forms of other lengths such as 11-inch forms, $5\frac{1}{2}$ inch forms and $3\frac{2}{3}$ inch forms, the mark 46′ will be used. As a further alternate, for 12-inch, 6-inch and 4-inch forms, the lineup 46″ may be similarly employed.

A second lineup indicia is also employed and includes a stationery lineup point 50 which, if desired, may form part of the frame of the mechanism. The roll 30 is provided with a cooperating mark 52 which is located on the roll 30 so that when aligned with the mark 50, the roll 30, and specifically, the print surface 34 thereon, will be at a predetermined angular position with respect to the printing nip. More specifically, the arrangement of the indicia 50 and 52 is chosen such that the angular distance between the center of the print surface 34 and the nip at the radius of the print surface is equal to a distance $D_2$. The radius of the print surface from the axis of rotation of the roll 30 is chosen to be $NL/2\pi$ where L is as previously defined in connection with the description of FIG. 2 and N is an integer equal to 1 or more. More specifically, N is equal to the number of printing surfaces 34 employed on the print roll 30. In the embodiment illustrated in FIG. 3, N is equal to 1. However, as will be seen, additional printing surfaces 34 can be used and will be equally angularly spaced about the periphery of the roll 30.

Returning to the mark 46 of the first indicia, the same is separated from the printing nip by a distance $D_1$. In the case illustrated in FIG. 3, $D_1$ is equal to $D_2$.

When the components are all properly aligned as mentioned previously, operation of the drive 40 may be initiated and, in every instance, printing will occur at the predetermined position on the form.

Since there are a variety of form lengths in use today, typically more than one of the first indicia will be employed as, for example, the indicia 46′ and the indicia 46″ as mentioned previously. It will be noted from FIG. 4 that the indicia 46, 46′ and 46″ are all separated from the printing nip at differing distances. It may then be questioned that since distance $D_1$ will vary for the particular one of the indicia 46, 46′, 46″, how accurate registry can be maintained for differing form lengths.

It will be recalled that the distance $D_2$ is measured along the angular path of movement of the printing surface of the plate 34, i.e., at the radius $NL/2\pi$. Since L will naturally vary for forms of differing lengths, and thus, the radius at which the print surface 34 is located must be changed for different form lengths, the difference is self-compensating. In other words, $D_2$ will increase for forms of increasing form lengths thereby necessitating an increase in $D_1$. The indicia 46' and 46'' are located accordingly.

It will be noted that the varying form lengths provided for each one of the indicia 46' and 46'', as illustrated in FIG. 4, may be accommodated simply by appropriately selecting the number of print surfaces on the roll. For example, with reference to 12, 6, and 4-inch forms employing the indicia 46'' as an index mark, for 12-inch forms, but a single print surface will be located on the roll 30. For a 6-inch form, two such surfaces will be employed and the same will be equally angularly spaced. For a 4-inch form, three equally angularly spaced printing surfaces will be employed.

FIGS. 3 and 4 also illustrate preferred means by which the mark 52 carried by the roller 30 may be disposed thereon. As best seen in FIG. 4, one end of the roller 30 is provided with a circular disc 60 carrying the mark 52 on its periphery. The disc 60 includes opposed arcuate slots 62 for receipt of clamping screws 64 receivable in tapped bores (not shown) in the end of the roller 30.

By loosening the screws 64, the disc 60 may be rotated to change the position of the mark 52 relative to the printing plate 34 as desired. Once the desired orientation of the mark 52 with respect to the printing plate 34 is obtained, the screws 64 may be tightened to firmly lock the disc 60 at the desired angular location with respect to the roll 30. Generally, such an adjustment will be made at the time of delivery of the apparatus to a customer and need not be changed thereafter.

The adjustment feature may also be employed to achieve proper alignment where the index mark 46, 46' and 46'' are not to be lined up with the center of the printing area. For example, if an operator of the apparatus desires to line up the mark 46 with the signature line 20, with no other change, printing would be centered on the line 20, a clearly undesirable result. In the situation illustrated in FIGS. 3 and 4, compensation for such a change in lineup could be made by rotating the disc 60 in a clockwise direction on the roll 30 a distance sufficient so that the mark 52 would move to the position illustrated in FIG. 3 an angular distance equal to the distance from the center of the printing area on the form length 12 shown in FIG. 4 to the signature line 20, which distance is illustrated as Y.

Figures 5, 6:
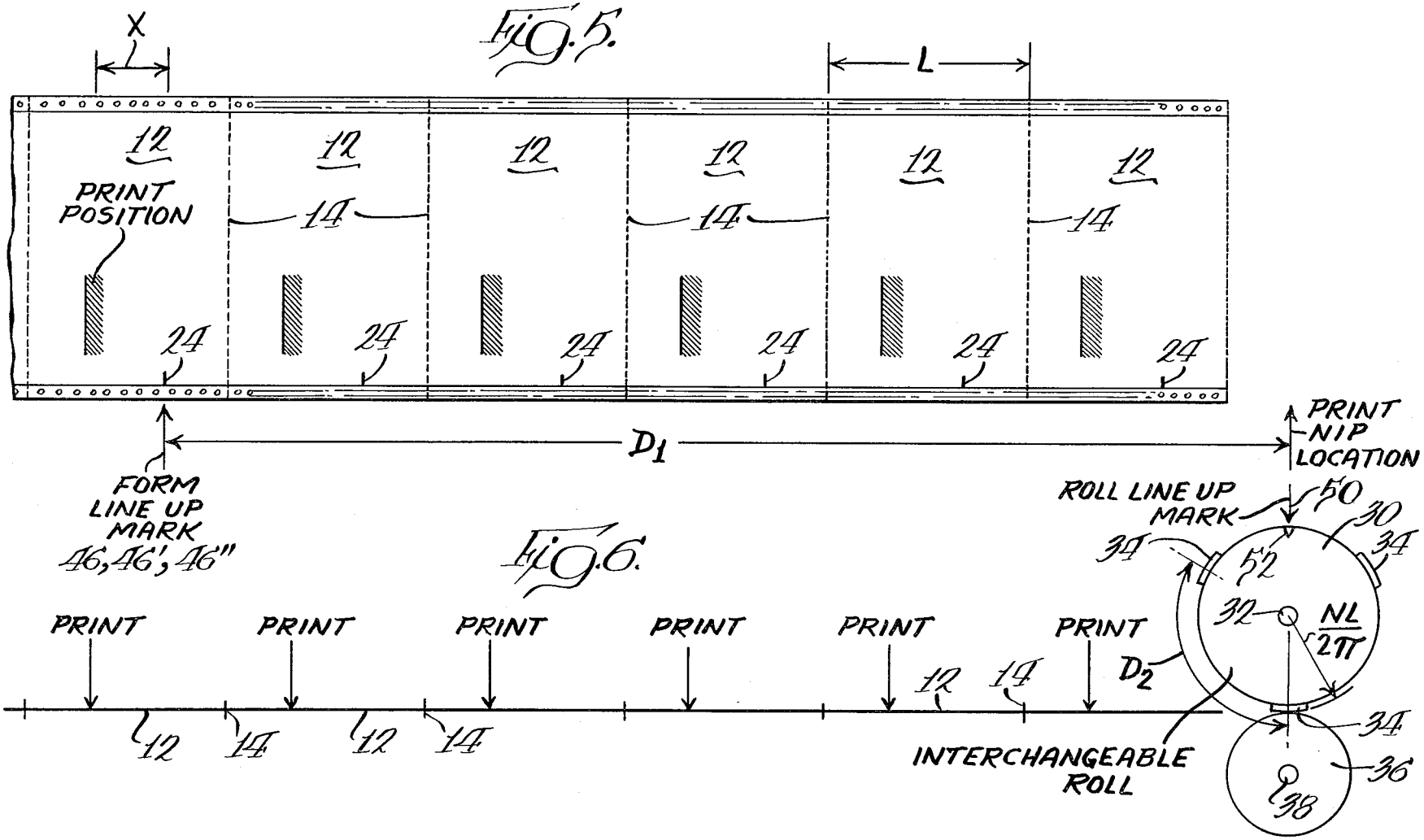
FIG. 5 is a plan view of a portion of a continuous business forms stationery assembly illustrating certain dimensional relationships to be employed in connection with the invention.
FIG. 6 is a somewhat schematic, side elevation of the form of FIG. 5 applied to the printing apparatus made according to the invention, the printing apparatus of FIG. 6 being a modified embodiment of the invention.

Those skilled in the art will recognize that the arrangement of parts illustrated in FIGS. 3 and 4 is but one such arrangement achieving the goals of the invention. In some instances, depending upon space requirements, it may be desirable to move the first set of indicia, that is, the marks 46, 46' and 46'' either toward or away from the printing nip. FIGS. 5 and 6 illustrate a modified arrangement wherein the first lineup indicia are moved away from the printing nip along the path of stationery travel. FIG. 6 also illustrates the employment of a roll having multiple, equally circumferentially spaced printing surfaces. Finally, FIGS. 5 and 6 illustrate a situation where an arbitrarily selected index mark 24 on each individual form 12, spaced from the center of the print receiving area by the distance X, is employed.

In order to achieve the results of the invention, in such a situation, the following relation is to be followed:

$$D_1 = D_2 \pm nL - X$$

In this relation, as previously, $D_1$ is the distance between the first lineup indicia and the printing nip, while $D_2$ is the distance from the center of the printing plate or surface 32 to the print nip taken in the path of movement of the printing surface, that is, at a radius equal to $NL/2\pi$. As mentioned previously, N is an integer equal to the number of printing surfaces employed on a roll, while L is the length of each form.

In the above expression, the term nL may either be positive or negative. When the first indicia 46 is moved toward the nip, the term nL will be negative, while when moved away from the nip, it will be positive. The term "*n*", is zero or an arbitrarily selected integer and will be determined in part by the distance the first indicia 46 has been moved towards or away from the nip in terms of form lengths and, where multiple printing surfaces on a single roll are employed, the surface employed in measuring the distance $D_2$. The term L remains equal to the individual form length.

The term X will be positive where, as illustrated in FIG. 5, the index mark 24 will precede the printing area through the printing nip. Conversely, when the index mark 24 employed follows the printing area through the printing nip, the term X will be negative. The latter situation is apparent from FIG. 4 if the signature line 20 is taken as the index mark 24. Thus, the distance designated Y could be compensated for without adjustment of the disc 60 through the incorporation of the same in the above relation as a negative value of X.

Those skilled in the art will also recognize that the foregoing relationship encompasses the arrangement illustrated in FIGS. 3 and 4. In that case, there is no X value, so that term drops out of the expression. Similarly, the term n is arbitrarily chosen to be zero, so that the term $\pm nL$ drops out leading the situation illustrated wherein $D_1$ is equal to $D_2$.

From the foregoing, it will be appreciated that a printing system made according to the invention achieves the foregoing objects of enabling accurate registration to be set up prior to the initiation of a run. Proper setup is easily achieved through the simple expedient of orienting the printing roll 30 to line up the second indicia marks 50 and 52 and applying the form to the tractor mechanism 42 in such a way that the first indicia 46, 46', 46'' are lined up with the center of a print position on a given form length or, if used, an arbitrary index point on the form.

Once properly set up, printing will always occur at the print position on every form length. Consequently, when checks, stock certificates, etc., are being processed, there is no possibility of improper printing requiring that one or more form lengths be destroyed and a bookkeeping operation indicating the voiding of the same performed.

It will also be appreciated that through the use of interchangeable printing rolls of varying sizes with varying numbers of printing surfaces, the vast majority of continuous business forms assemblies of differeing form lengths in use today can be processed with the printing apparatus of the present invention.

Finally, while the invention has been described in connection with printing rolls, those skilled in the art will appreciate that the principles of the invention are applicable to those types of printing devices wherein the printing surface moves in a closed, noncircular path. In such a case, the distance $D_2$ is measured along the path of movement of the printing surface. The length of the closed path should be equal to NL, where, as previously, N is an arbitrarily selected integer of 1 or more and L is the length of each individual form.

I claim:

1. Stationery printing apparatus for printing indicia at a predetermined position on each form length of continuous business forms stationery assemblies formed of at least one elongated web of stationery separated into said form lengths by transverse, equally spaced lines of weakening, said apparatus comprising:

a rotary printing roll having N equally circumferentially spaced printing surfaces thereon, said surface or surfaces being radially spaced from the axis of rotation of the roll a distance equal to $NL/2\pi$, where L is the distance between two adjacent transverse lines of weakening, and N is an integer equal to 1 or greater, impression means associated with said roll to define a printing nip so that continuous business forms passing through said nip will be imprinted upon by said printing surface at said nip, means for conveying a continuous business forms assembly along a path of stationery travel extending through said nip including a drive mechanism forwardly of said nip for positively advancing stationery along said path to said nip at a desired linear velocity, means for rotating said roll such that said printing surface is rotated at an angular velocity equal to said linear velocity, at least one first lineup indicia located along said path and forwardly of said nip, a second lineup indicia operatively associated with said roll whereby said roll may be initially located at a predetermined angular position about its axis of rotation, said first indicia being spaced from said nip by a distance $D_1$, and said second indicia being positioned such that when said roll is in said predetermined angular position said printing surface will be angularly spaced from said nip by a distance $D_2$, and wherein $D_1$ is related to $D_2$ as follows:

$$D_1 = D_2 \pm nL - X$$

where $n$ is zero or an integer of 1 or greater, and X is the longitudinal distance, if any, between said predetermined position on a form length and an arbitrarily selected index point, if any, on the form length to be aligned with said first lineup indicia, whereby when said roll is located in said predetermined angular position using said second indicia and a continuous business forms assembly having forms with individual lengths equal to L is initially positioned with said predetermined position or the arbitrarily selected index point, if any, of one of the form lengths adjacent said first indicia, upon operation of said conveying means, the form lengths will be imprinted upon at said predetermined positions thereon.

2. Stationery printing apparatus according to claim 1 and further including means adjustably mounting said lineup indicia for selective, adjustable movement relative to said printing surface.

3. Stationery printing apparatus according to claim 2 wherein said adjustable mounting means is secured to said printing roll.

4. Stationery printing apparatus for printing indicia at a predetermined position on each form length of continuous business forms stationery assemblies formed of an elongated series of interconnected individual business forms, each of equal length, said apparatus comprising:

a rotary printing roll having at least one printing surface thereon;

impression means associated with said roll to define a printing nip so that a continuous business forms assembly passing through said nip will be imprinted upon by said printing surface at said nip, means for moving a continuous business forms assembly along a path of stationery travel extending through said nip including a drive mechanism forwardly of said nip, means for rotating said print roll in timed relation with said moving means, at least one first lineup indicia located along said path and forwardly of said nip, a second lineup indicia associated with said roll whereby said roll may be initially located at specific predetermined location about its axis of rotation, said first and second indicia being located along said path and on said roll, respectively, such that when said roll is in said predetermined location, and a predetermined point on a continuous business forms assembly in said path is aligned with said first indicia, upon operation of said moving means, the form lengths will be imprinted upon at said predetermined position thereon.

5. The stationery printing apparatus of claim 4 further including means mounting one of said first and second indicia for adjustable movement with respect to said nip.

6. The stationery printing apparatus of claim 5 wherein said moving means is operative to drive a continuous business forms assembly along said path at a desired linear velocity and said rotating means is operative to rotate said roll such that said printing surface moves an an angular velocity equal to said linear velocity.

7. Stationery printing apparatus for printing indicia at a predetermined position on each form lenth of continuous business forms stationery assemblies formed of an elongated series of interconnected individual business forms, each of equal length, said apparatus comprising: printing means having at least one printing surface cyclically movable through a closed path including a printing position; means for moving a continuous business forms assembly along a path of stationery travel extending throuh said printing position and including a drive mechanism forwardly of said printing position; means for moving said printing surface in timed relation with said continuous business forms assembly moving means; at least one first lineup indicia located along said path of stationery travel and forwardly of said printing position; a second lineup indicia associated with said printing means whereby said printing surface may be initially located at a specific predetermined location in said closed path; and means mounting one of said first and second indicia for relative adjustable movement with respect to said printing position whereby said first and second indicia may be oriented with respect to said printing position such that when said printing surface is in said predetermined location, and a predetermined point on a continuous business forms assembly in said path of stationery travel is aligned with said first indicia, upon movement of a forms assembly, the form lengths will be imprinted upon at said predetermined positions thereon.

8. Stationery printing apparatus according to claim 7 wherein said mounting means mounts said second indicia for said adjustable movement.

9. Stationery printing apparatus for printing indicia at a predetermined position on each form length of continuous business forms stationery assemblies formed of an elongated series of interconnected individual business forms, each of equal length, said apparatus comprising: a printing device having N equally spaced printing surface movable through a closed path therewith, said closed path extending through a printing position and having a length equal to NL wherein N is an integer equal to 1 or greater and L is the length of each individual form in the continuous business forms stationery assembly; means for conveying a continuous business forms assembly along a path of stationery travel extending through said printing position and including a drive mchanism forwardly of said printing position for positively advancing stationery along said path of stationery travel to said printing position at a desired linear velocity, means for moving said printing surfaces at a velocity through said closed path equal to said linear velocity whenever said drive mechanism is operative; at least one first lineup indicia located along said path of stationery travel and forwardly of said printing position; a second lineup indicia operatively associated with said printing means whereby said printing surface may be initially located at a predetermined location in said closed path; said first indicia being spaced from said printing position by a distance $D_1$, said second indicia being positioned such that when said printing surface is in said predetermined location in said closed path, said printing surface will be spaced from said printing position along said closed path by a distance $D_2$, and wherein $D_1$ is related to $D_2$ as follows:

$$D_1 = D_2 \pm nL - X$$

where: $n$ is zero or an integer of 1 or greater, and X is the longitudinal distance, if any, between said predetermined position on a form length and an arbitrarily selected index point, if any, on the form length to be aligned with said first lineup indicia, whereby when said printing surface is located in said predetermined location using said second indicia and a continuous business forms assembly having forms with individual lengths equal to L is initially positioned with said predetermined position or the arbitrarily selected index point, if any, of one of the form lengths adjacent said first indicia, upon operation of said conveying means, the form lengths will be imprinted upon at said predetermined positions thereon.

* * * * *